US005110192A

United States Patent [19]

Lauterbach

[11] Patent Number: 5,110,192

[45] Date of Patent: May 5, 1992

[54] APPARATUS FOR STORING AND DISPENSING OBJECTS, SUCH AS IN PARTICULAR PACKETS OF CIGARETTES, BOXES AND OTHER LIKE ARTICLES, OF PARALLELEPIPEDIC OR CYLINDRICAL SHAPE

[76] Inventor: Jacques Lauterbach, Paquier du Charmois - Talmay, 21270 - Pontailler-sur-Saone, France

[21] Appl. No.: 509,948

[22] Filed: Apr. 16, 1990

[51] Int. Cl.[5] ..... B65G 1/16

[52] U.S. Cl. ..... 312/71; 211/59.3; 211/124; 211/279

[58] Field of Search ..... 221/92, 123-124, 221/191, 195, 241-242, 279, 131; 211/54.1, 59.3, 51, 184; 312/71, 61; 198/746, 747

[56] References Cited

U.S. PATENT DOCUMENTS

| | | | |
|---|---|---|---|
| 2,085,479 | 6/1937 | Shaffer et al. | 211/59.3 |
| 2,462,816 | 2/1949 | Schner, Jr. et al. | 221/92 |
| 3,104,137 | 9/1963 | Cohen | 312/71 |
| 3,348,732 | 10/1967 | Schwarz | 221/279 |
| 3,674,175 | 7/1972 | Jaquish | 221/311 |
| 3,881,633 | 5/1975 | Bradt | 221/123 |
| 4,378,872 | 4/1983 | Brown | 221/124 |
| 4,850,511 | 7/1989 | Kral et al. | 221/242 |

FOREIGN PATENT DOCUMENTS

| | | |
|---|---|---|
| 2232398 | 1/1974 | Fed. Rep. of Germany . |
| 2026207 | 9/1970 | France . |
| 412251 | 4/1966 | Switzerland . |

*Primary Examiner*—H. Grant Skaggs

*Attorney, Agent, or Firm*—McAulay Fisher Nissen Goldberg & Kiel

[57] ABSTRACT

This invention relates to an apparatus for storing and dispensing parallelepipedic or cylindrical objects, such as boxes, packets or like articles, characterized in that the pusher is constituted by a blade extending across the passage between two successive partitions defining the same passage, each partition comprising on its four upper, lower, front and rear edges, respectively, an upper, lower, front and rear groove, each of these grooves being laterally defined by a wall, on one of which slides the auxiliary body which has the general shape of a rectangular plate disposed vertically lengthwise and comprising, at the location of each of its top and bottom horizontal sides, a U-shaped channel constituted by two plates mounted square so as to form a horizontal slideway overlapping respectively the upper and lower edge of said wall of the partition, to constitute the members for guiding the pusher.

20 Claims, 2 Drawing Sheets

APPARATUS FOR STORING AND DISPENSING OBJECTS, SUCH AS IN PARTICULAR PACKETS OF CIGARETTES, BOXES AND OTHER LIKE ARTICLES, OF PARALLELEPIPEDIC OR CYLINDRICAL SHAPE

FIELD OF THE INVENTION

The present invention relates to an apparatus for storing and dispensing objects, such. as in particular packets of cigarettes, boxes and other like articles, of parallelepipedic or cylindrical shape.

BACKGROUND OF THE INVENTION

Apparatus for storing and dispensing packets or boxes are already known, which comprise a principal body in the form of a box or drawer, comprising two longitudinal lateral sides, a front side and a rear side both perpendicular to the preceding ones, and a bottom, the principal body being divided into a certain number of elongated passages in the direction of the lateral sides, with the aid of an appropriate number of partitions, parallel to one another and between which the objects are placed in line, one behind the other, a pusher mounted for longitudinal slide is allocated to each passage so that it is applied against the last object of the line, elastic means cooperating with each of the pushers to urge said pushers in the direction of the front side of the principal body, with the result that the first object of the line comes into abutment against the same front side, each pusher being rigidly associated with a slide block mounted for longitudinal slide with the aid of members adapted to ensure continuous guiding of said pusher over the whole length of its displacement.

Such apparatus present numerous drawbacks, and principally the fact that the assembly formed by a pusher and its auxiliary elements occupy a considerable amount of room in a passage of the principal body, resulting in the space for one object in each passage being wasted.

It is an object of the present invention to overcome these various drawbacks by providing a storing and dispensing apparatus of particularly simple design which may be very easily adapted to all types of available principal bodies of different width and/or depth, with the additional advantage of a low cost price.

SUMMARY OF THE INVENTION

To that end, the apparatus according to the invention for storing and dispensing parallelepipedic or cylindrical objects, is characterized in that the pusher is constituted by a blade extending across the passage between two successive partitions defining the same passage, each partition comprising on its four upper, lower, front and rear edges, respectively, an upper, lower, front and rear groove, each of these grooves being laterally defined by a wall, on one of which slides the auxiliary body which has the general shape of a rectangular plate disposed vertically lengthwise and comprising, at the location of each of its top and bottom horizontal sides, a U-shaped channel constituted by two plates mounted square so as to form a horizontal slideway overlapping respectively the upper and lower edge of said wall of the partition, to constitute the members for guiding the pusher.

Thus constructed, this apparatus makes maximum use of the length of the passage and it recovers the space for the last object of the line, usually wasted in the apparatus of this type. Furthermore, the pusher equipping each passage of the apparatus, cooperating exclusively with one of the partitions forming said passage to obtain guiding thereof and its return mechanism, requires no margin of height within the passages, receiving in the majority of the prior art apparatus the return mechanism of said pusher. In this way, the height of the apparatus according to the invention may be reduced to the height of the objects that it contains.

The partition, pusher and elastic means associated therewith constitute an assembly which may be removed and positioned in one piece, offering the further advantage of being able to adjust the width of the passage depending on the width of the objects positioned in the apparatus, these objects being, moreover, able to be of different width from one passage of the apparatus to the other.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
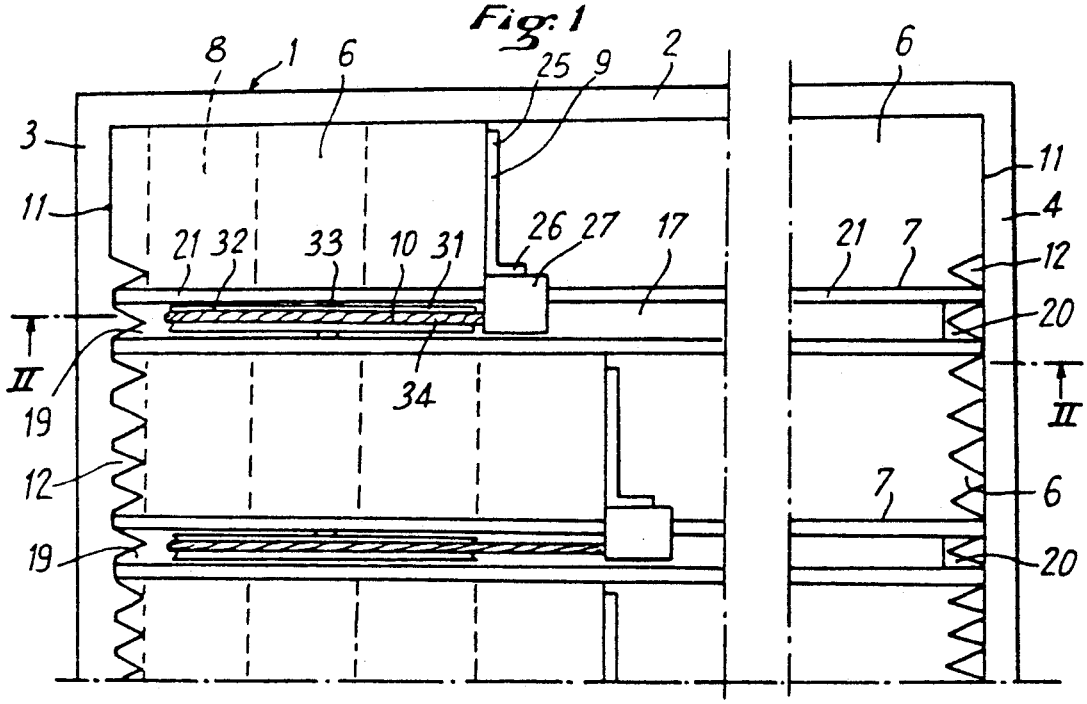
FIG. 1 is a view in partial section of the apparatus according to the invention.

Referring now to the drawings, and firstly to FIG. 1, the apparatus according to the invention for storing and dispensing parallelepipedic or cylindrical objects 8 comprises a principal body 1 in the form of a box or drawer, comprising two lateral sides 2, a front side 3 and a rear side 4 both disposed perpendicularly to the preceding ones, and a bottom 5.

The principal body 1 is divided, in the direction parallel to the front side 3, into a certain number of elongated passages 6 in the direction of the lateral sides 2, with the aid of an appropriate number of partitions 7, parallel to one another.

In each passage 6 are placed the objects 8 in unitary manner widthwise of the passage 6 and, in line one behind the other, lengthwise of the same passage 6.

Each of the passages 6 is provided with a pusher 9, mounted to slide longitudinally in the passage and applied against the last object 8 of the line facing the rear side 4 of the principal body 1. Elastic means 10 are allocated to each of the pushers 9; these elastic means 10, stretched, urge the pusher 9 towards the front side 3 of the principal body 1, with the result that the first object 8 of the line comes into abutment against this front side 3 and whenever an object is removed from the apparatus, the following object in the line takes its place, shifting all the objects 8 of the line by one step equal to the thickness of an object 8.

Partitions 7 of this apparatus are of an appropriate length depending on the depth of the principal body 1, with the result that they abut on the inner faces 11 of the front side 3 and of the rear side 4 of the principal body 1 of the apparatus.

Figure 2:
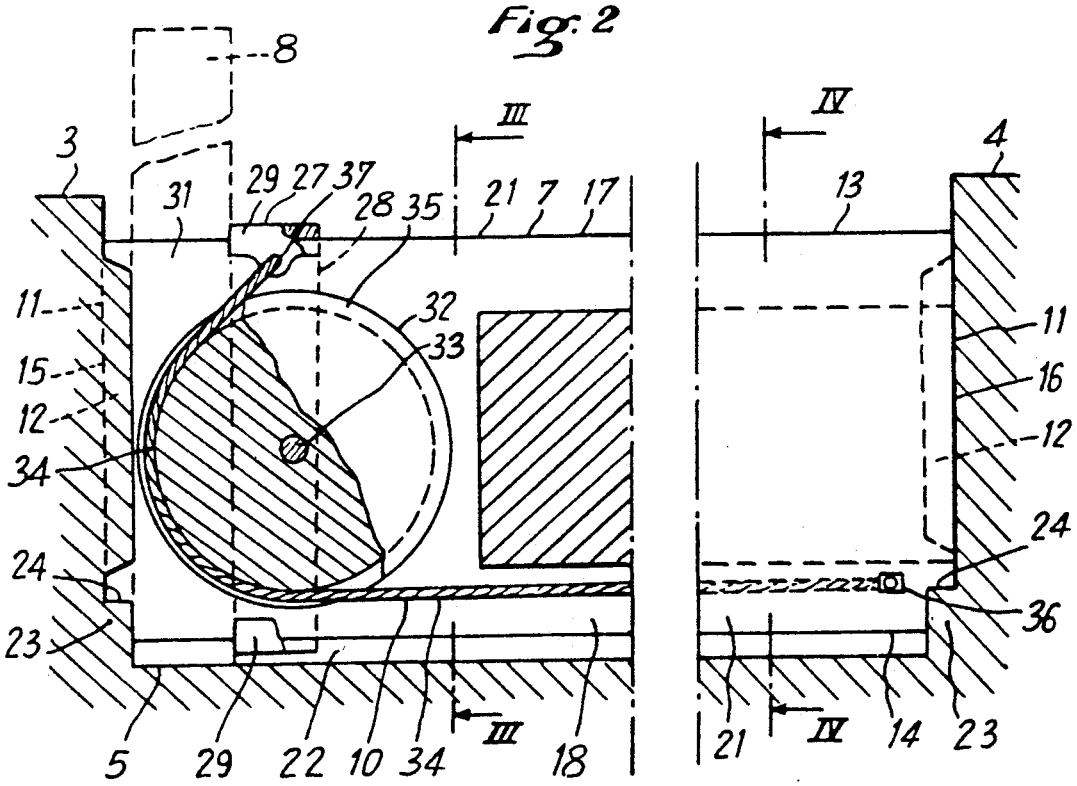
FIG. 2 is a view in section made along line II—II of FIG. 1.

These inner faces 11 are each provided with a series of vertical teeth 12, extending perpendicularly to the bottom 5 of the principal body 1, without, however, attaining it completely, in accordance with FIG. 2.

Teeth 12 present, in plan view, as indicated in FIG. 1, the appearance of a series of comb teeth, extending over the whole width of the apparatus.

Each partition 7 of the apparatus, generally rectangular in shape, comprises on its four edges, viz. upper (13), lower (14), front (15), facing the front side 3 of the principal body 1, and rear (16), facing the rear side 4 of the principal body 1, an upper groove 17, a lower groove 18, a front groove 19 and a rear groove 20, respectively.

Each of these grooves 17, 18, 19, 20 is laterally defined by a wall 21.

The distance between the inner faces of the walls 21 of the front and rear grooves 19 and 20 respectively, as well as the depth of these grooves, on the one hand, and the free spacing between the teeth 12 of the inner faces 11 on the other hand, are such that, in order to position partition 7, it is necessary to slide the partition 7 vertically towards the bottom 5, inserting walls 21 between two successive teeth. The spacing between two successive partitions, widthwise of the principal body 1, may be given the dimensions necessary for introducing between these partitions 7 the desired objects 8, according to the circumstances.

Figure 5:
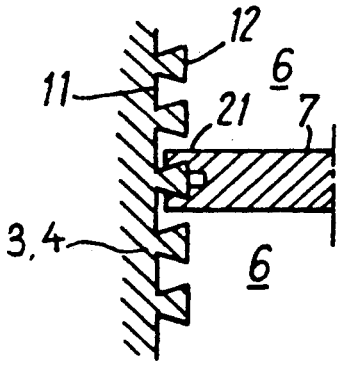
FIG. 5 is a detailed view in section of the means for fixing the partition to the inner face of the front and rear sides of the principal body of the apparatus according to the invention.

The most simple shape of the teeth 12 in transverse cross-section is triangular, as shown in FIG. 1. However, it is possible for this transverse cross-section of the teeth 12 to be shaped in any other manner, for example in dove-tail form, as shown in FIG. 5; the walls 21 will in that case be shaped in complementary manner, in accordance with a conventional tenon/mortise technique. This assembly naturally ensures better holding of the partition 7. It goes without saying that any other particular shape of assembling the partitions 6 on the walls 11 would come within the field of the invention.

In addition, it is necessary, for reasons which will be specified hereinafter, to arrange a free space 22 between the lower edge 14 of each partition 7 and the bottom 5. To that end, partition 7 is provided, at the two ends of the lower edge 14, on each side, with a rectangular cut-out 23. The two front and rear sides 3 and 4 are in that case each provided, towards the bottom 5, with a threshold 24. The rectangular cut-out 23 cooperating with the threshold 24, on which it abuts to limit the descent of the partition 7 towards the bottom 5, forming the free space 22. According to another embodiment, this free space 22 may also be made by shaping one of the walls 21 defining the lower groove 18 so that it is shorter, in the direction of the bottom 5, whilst the other wall 21 opposite abuts on the bottom 5.

Figure 3:
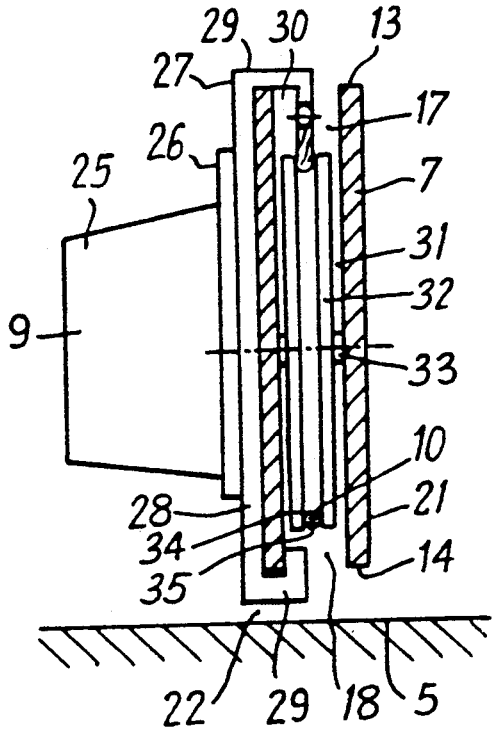
FIG. 3 is a view in section made along line III—III of FIG. 2.
Figure 4:
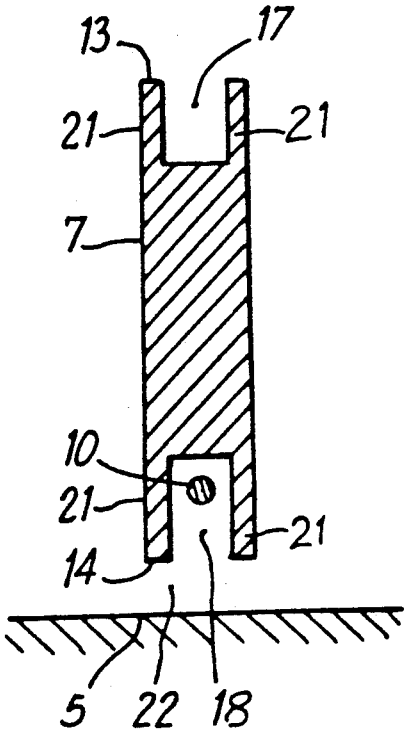
FIG. 4 is a view in section made along line IV—IV of FIG. 2.

According to the present invention, as shown in FIG. 3, each pusher 9 is constituted by a blade 25 of generally rectangular or trapezoidal form, extending across the passage 6, between two successive partitions 7 defining the same passage, without contact either with the partition 7 not bearing said blade 25, or with the bottom 5 or the upper edge of the partition 7. This blade 25 is adapted to come, along one of its faces extending across the passage 6, against the last object 8 of the line of objects, that it tends to push towards the front of the apparatus.

The blade 25 is associated with a raised edge 26 and connected by known means, welding or any other, to a slide block 27 of which the general shape is that of a rectangular plate 28 applied against the outer wall of the partition 7. This rectangular plate 28 comprises, at the location of each of its top and bottom narrow sides, a U-shaped channel 29 constituted by two plates placed square, rigidly associated with the rectangular plate 28 so as to produce an elongated slideway 30. The dimensions of the rectangular plate 28, in the direction of height of the partition 7, is such that the elongated slideways 30 of the channels 29 respectively receive the upper and lower edges of one of the walls 21 on the same side of the partition 7, overlapping this wall. The slide block 27 may consequently move along the partition 7, without being able to leave it in the transverse direction of the passage 6. The blade 25, effectively constituting the pusher 9, thus comes into abutment on the object 8 and accompanies it in its displacement in the manner of a vice, guided continuously along the partition 7, by the high and low channels 29, over the whole length of its displacement.

The role of the lower free space 22, necessary for the slide on the fixed partition 7 of the channel 29 overlapping the lower edge of the wall 21 of the groove 18, will now be understood.

According to the present invention, the front groove 19 is much deeper than the other three grooves 17, 18, 20 cut in the edge of partition 7, in order to constitute a chamber 31, opening on three sides in the upper edge 13, lower edge 14 and front edge 15 of partition 7. A wheel 32 rotating freely on a shaft 33 borne by the walls 21 is mounted in chamber 31.

Elastic means 10 are partially wound in the peripheral notch 35 of the wheel 32. These elastic means 10 are constituted by an elongated elastic body 34, for example a rubber-insulated wire or a finely spirally wound spring, wrapped or not, or any other equivalent means. This elastic body 34 is fastened by one of its end parts to a catch 36 borne by the inner face of the wall 21 of the lower groove 18, in its terminal part in the vicinity of the rear side 4 of the principal body 1. The elastic body 34 is fastened by the other of its end parts to a second catch 37, borne by the upper channel 29 of the auxiliary body or slide block 27, in the upper groove 17 of the partition. It is clear that this end of the elastic body 34 may equally well be fastened to an eyelet borne by the upper channel 29 consequently driving the auxiliary body 27.

The taut elastic body 34 consequently extends between the catch 36, fast with the partition 7, along the lower groove 18 borne by the partition 7 towards the bottom 5 of the principal body 1; it then passes in the notch 35 of the wheel 32 and is finally fastened to the catch or to the eyelet 37 borne by the upper channel 29 of the auxiliary body 27, fast with the blade 25 constituting the pusher 9 applied against the last object 8 of the line, towards the rear side of the principal body 1.

According to the invention, partition 7, wheel 32, the elastic means 10, the auxiliary body 27 with its upper and lower channels 29, and the blade 25 constituting the pusher 9, form an assembly independent of the principal body 1 of the apparatus, adapted to be removed and returned into position with the aid of the vertical teeth 12, with any desired transverse distance, to adapt to the dimensions of the objects 8 that it is desired to place in the apparatus. These objects 8 may therefore be different from one passage 6 to the other.

What is claimed is:

1. In an apparatus for storing and dispensing objects, such as boxes and packets, of a solid shape, comprising:

a principal body in the form of a box means, including two longitudinal lateral sides, a front side and a rear side both perpendicular to the preceding ones, and a bottom, said principal body being divided into a certain number of elongated passages in the direction of the lateral sides, with the aid of an appropriate number of partitions, parallel to one another and between which the objects are placed in line, one behind the other;

a pusher mounted for longitudinal slide allocated to each of said elongated passages so that it is applied against the last object of the line;

elastic means cooperating with each of said pushers to urge said pushers, on a front side of the principal body, with the result that the first object of the line comes into abutment against the same front side;

each said pusher being rigidly associated with an auxiliary or slide block means mounted or longitudinal slide with the aid of appropriate members to ensure continuous guiding of said pusher over the whole length of its displacement;

said pusher being constituted by a blade extending across the passage between two successive partitions defining the same passage;

each said partition comprising on its four upper, lower, front and rear edges, respectively, an upper, lower, front and rear groove;

each of said grooves being laterally defined by a wall, on one of which slides the auxiliary body means which has the general shape of a rectangular plate disposed vertically lengthwise and comprises, at the location of each of its top and bottom horizontal sides, a U-shaped channel constituted by two plates mounted square so as to form a horizontal slideway overlapping respectively the upper and lower edge of said wall of the partition, to constitute the members for guiding the pusher;

said front groove being much deeper than the other three grooves in order to constitute a chamber in which is mounted a wheel rotating freely on a shaft borne by the walls; and said elastic means including a taut, elongated, elastic body connected with and extending between a first catch means borne by the partition in the lower groove, passing along this lower groove, then in a notch in the wheel and being fastened to a second catch means borne by the upper channel of the auxiliary body.

2. In the apparatus of claim 1, wherein the partition is provided, at the two ends of the lower edge, on each side, with a rectangular cut-out, the two front and rear sides each being provided, towards the bottom, with a threshold inserted in said cut-outs to limit the descent of the partition towards the bottom, forming a free space.

3. In the apparatus of claim 2, wherein the inner faces of the front and rear sides of the principal body are provided with a series of teeth extending perpendicularly with respect to the bottom without reaching it, these teeth presenting, seen in plan view, the appearance of a series of comb teeth, each wall being inserted between two successive teeth.

4. In the apparatus of claim 1, wherein the partition, the wheel, the elastic means, the auxiliary body with its upper and lower channels and the blade constitute an assembly independent of the principal body.

5. In the apparatus of claim 1, wherein the inner faces of the front and rear sides of the principal body are provided with a series of teeth extending perpendicularly with respect to the bottom without reaching it, these teeth presenting, seen in plan view, the appearance of a series of comb teeth, each wall being inserted between two successive teeth.

6. In the apparatus of claim 5, wherein a transverse cross-section of the teeth is dove-tailed in shape, the front and rear walls presenting a complementary cross-section.

7. In the apparatus of claim 5, wherein a transverse cross-section of the teeth is triangular in shape.

8. In the apparatus of claim 1, wherein the second catch means is a catch.

9. In the apparatus of claim 1, wherein the second catch means is an eyelet.

10. In the apparatus of claim 1, wherein the object dispensed is of a paralellepipidic shape.

11. In the apparatus of claim 1, wherein the object dispensed is of a cylindrical shape.

12. In an apparatus for storing and dispensing objects, such as boxes and packets having a solid, cylindraceous shape, comprising:

a principal body in the form of drawer means, including two longitudinal lateral sides, a front side and a rear side both perpendicular to the preceding ones, and a bottom, said principal body being divided into a certain number of elongated passages in the direction of the lateral sides, with the aid of an appropriate number of partitions, parallel to one another and between which the objects are placed in line, one behind the other;

a pusher mounted for longitudinal slide allocated to each of said elongated passages so that it is applied against the last object of the line;

elastic means cooperating with each of said pushers to urge said pushers, on a front side of the principal body, with the result that the first object of the line comes into abutment against the same front side;

each said pusher being rigidly associated with an auxiliary body or slide block mounted for longitudinal slide with the aid of appropriate members to ensure continuous guiding of said pusher over the whole length of its displacement;

said pusher being constituted by a blade extending across the passage between two successive partitions defining the same passage;

each said partition comprising on its four upper, lower, front and rear edges, respectively, an upper, lower, front and rear groove; and each of said grooves being laterally defined by a wall, on one of which slides the auxiliary body which has the general shape of a rectangular plate disposed vertically lengthwise and comprises, at the location of each of its top and bottom horizontal sides, a U-shaped channel constituted by two plates mounted square so as to form a horizontal slideway overlapping respectively the upper and lower edge of said wall of the partition, to constitute the members for guiding the pusher;

said partition being provided, at the two ends of the lower edge, on each side, with a rectangular cut-out, the two front and rear sides each being provided, towards the bottom, with a threshold inserted in said cut-outs to limit the descent of the partition towards the bottom, forming a free space.

13. In the apparatus of claim 12, wherein the object is of a paralellepipidic shape.

14. In the apparatus of claim 12, wherein the object is of a cylindrical shape.

15. In the apparatus of claim 12, wherein the partition, the elastic means, the auxiliary body with its upper and lower channels and the blade constitute an assembly independent of the principal body.

16. In the apparatus of claim 12, wherein the inner faces of the front and rear sides of the principal body are provided with a series of teeth extending perpendicularly with respect to the bottom without reaching it, these teeth presenting, seen in plan view, the appearance of a series of comb teeth, each wall being inserted between two successive teeth.

17. In the apparatus of claim 16, wherein a transverse cross-section of the teeth is triangular in shape.

18. In the apparatus of claim 16, wherein a transverse cross-section of the teeth is dove-tailed in shape, the front and rear walls presenting a complementary cross-section.

19. In an apparatus for storing and dispensing objects, having a solid configuration, comprising:

a principal body in the form of a box means, including two longitudinal lateral sides, a front side and a rear side both perpendicular to said lateral sides, and a bottom, said principal body being divided into a number of elongated passages in the direction of the lateral sides, with the aid of an appropriate number of partitions, parallel to one another and between which the objects are placed in line, one behind the other;

a pusher mounted for longitudinal slide allocated to each of said elongated passages so that it is applied against the last object of the line;

individual elastic means cooperating with each of said pushers for urging thereof on the front side of said principal body, with the result that the first object of the line comes into abutment against the same front side, each said pusher being rigidly associated with slide block means mounted for longitudinal slide with the aid of appropriate members to ensure continuous guiding of said pusher over the whole length of its displacement;

said pusher being constituted by a blade extending across the passage between two successive partitions defining the same passage, each said partition comprising on its four upper, lower, front and rear edges, respectively, an upper, a lower, front and rear groove, each said grooves being laterally defined by a wall, on one of which the slide block means slides having the general shape of a rectangular plate disposed vertically lengthwise and comprising, at the location of each of its top and bottom horizontal sides, a U-shaped channel constituted by two plates mounted square so as to form a horizontal slideway overlapping respectively the upper and lower edge of said wall of the partition, to constitute the members for guiding the pusher;

said front groove being much deeper than the other three grooves in order to constitute a chamber in which is mounted a wheel rotating freely on a shaft borne by the walls; and said individual elastic means including a single taut, elongated, elastic body having its ends extending connected to and between first and second catch means, said first catch means being borne by the partition and said elastic body extending in the lower groove, passing along this lower groove, then in a notch in the wheel and being fastened to said second catch means borne by the upper channel of the auxiliary body.

20. In the apparatus of claim 19, wherein the partition is provided, at the two ends of the lower edge, on each side, with a rectangular cut-out, the two front and rear sides each being provided, towards the bottom, with a threshold inserted in said cut-outs to limit the descent of the partition towards the bottom, forming a free space.

* * * * *